United States Patent [19]

Weller et al.

[11] 4,296,625

[45] Oct. 27, 1981

[54] CRANK PRESS WITH LATERAL ROD EJECTOR

[75] Inventors: Alois Weller, Erkrath; Wolfgang Mai, Kaarst, both of Fed. Rep. of Germany

[73] Assignee: Kieserling & Albrecht, Solingen, Fed. Rep. of Germany

[21] Appl. No.: 51,235

[22] Filed: Jun. 22, 1979

[30] Foreign Application Priority Data

Jun. 23, 1978 [DE] Fed. Rep. of Germany ..... 2827561

[51] Int. Cl.[3] ..... B21D 45/00

[52] U.S. Cl. ..... 72/345; 10/11 E; 72/427

[58] Field of Search ..... 72/344, 345, 346, 427; 10/11 R, 11 E

[56] References Cited

U.S. PATENT DOCUMENTS

| | | | |
|---|---|---|---|
| 2,450,621 | 10/1948 | Wireman | 10/11 E |
| 2,547,304 | 4/1951 | Broscomb | 10/11 E X |
| 2,935,212 | 5/1960 | Braun et al. | 10/11 E |
| 3,619,835 | 11/1971 | Nebendorf | 10/11 E |
| 3,820,376 | 6/1974 | Koch et al. | 72/427 |
| 4,014,203 | 3/1977 | Koch et al. | 72/427 |
| 4,091,486 | 5/1978 | Kalt | 10/11 E |

*Primary Examiner*—Leon Gilden

[57] ABSTRACT

In an improved crank press arrangement including a sled which is reciprocally mounted on the frame of the arrangement. A toggle lever is pivotably mounted on the sled. One arm of the toggle lever has a cam-follower roller whereas the other arm coacts with an ejector arm slidably mounted in the sled. A crank drive reciprocates the sled. A control cam is in contact with the cam-follower. The ejector rod coacts with a blank and a die to form a workpiece. The crank drive and control arm are operatively connected by means of a gear train. The contour and shape of the control cam is such that while the cam-follower roller is in continuous contact therewith, nevertheless a temporary standstill of the ejector rod occurs during the operative cycle of the arrangement.

3 Claims, 3 Drawing Figures

1
2
15
16
17
18
19
8
6
7
2
10
9
2
13
5
4
14

CRANK PRESS WITH LATERAL ROD EJECTOR

BACKGROUND OF THE INVENTION

The invention relates to a crank press having a lateral rod ejector. The arrangement of the invention includes a reciprocating sled actuated by a crank drive, the side facing the die having a rod holder, a press ram and a reciprocating ejector rod reciprocably mounted in the press ram. The ejector rod is actuated by an angle or toggle lever which is entrained by the sled movement, said toggle lever being in continuous contact with a control cam via a roller, the motion of which being provided by a gear wheel mounted on the crank shaft.

There is already known and disclosed in German Pat. No. 1,750,033 an arrangement in a crank press for transferring the rotary movement of the main crank drive coacting with the drive of a reciprocating sled and having a stationarily mounted auxiliary crank drive having the same crank radius and an identical crank rod length as the main crank drive. The auxiliary crank drive is arranged parallel to the main crank drive and is coupled to it via a gear wheel chain and via a swing frame pivotally mounted about the control shaft. The control cam coacts with a toggle lever which furnishes a stroke limit for the ejector. The entire known arrangement serves the purpose to attain by means of a coincidence of the angular velocity of the main and auxiliary crank drive a predetermined reciprocating motion and stroke sequence of the ejector.

The drawbacks of this known driving arrangement for a crank press are easily recognizable:

First of all, the construction of the auxiliary crank is expensive; secondly, a swing frame mounted on the control shaft is required in which all of the gear wheels coacting with the sled are mounted. Consequently, the gear wheels, which are continuously engaging each other, undergo the swing movement of the swing frame in conformance with the movement of the auxiliary crank shaft drive which causes at least a certain additional motion in the machine due to vibration.

SUMMARY OF THE INVENTION

It is an object of the invention to provide an improved crank press with a lateral rod ejector in which the aforedescribed drawbacks are avoided.

It is another object of the invention to provide such a crank press in which the travelling time of the ejection motion can be predetermined by simple means. In addition thereto, the ejector rod carries out its operative cycle in a synchronous phase displacement of 180° relative to the sled motion within a predetermined angular range of the crank shaft motion.

The object of the invention is achieved by providing a spatial standstill effect by the actuating cam of the toggle lever during a predetermined crank shaft angular range.

Yet another feature of the invention resides in that the number of revolutions of the cam drive shaft and the crank shaft are equal, but that the rotary direction of both shafts are opposite with respect to each other.

Lastly, in accordance with the invention, the drive cam shaft is mounted on the machine frame. In view of the fact that the drive for all gear wheels is carried out by the crank shaft gear wheel mounted on the crank shaft and further that the control cam when rotating has the same angular velocity as the drive gear wheel with the control cam gear wheel mounted on the drive shaft, there results for the control cam an exact synchronous motion relative to the crank shaft. This makes possible a coaction with the roller of the toggle lever in view of the special configuration of the control cam thereby making possible a predetermined motion of the ejector rod determined by the sled movement, including a synchronous run in a predetermined region of the sled motion phase displaced from it by 180°.

BRIEF DESCRIPTION OF THE DRAWING

In order that the invention may be more readily understood, reference is made to the accompanying drawings, which illustrate diagrammatically and by way of example one embodiment thereof, and in which.

DETAILED DESCRIPTION

Figure 1:
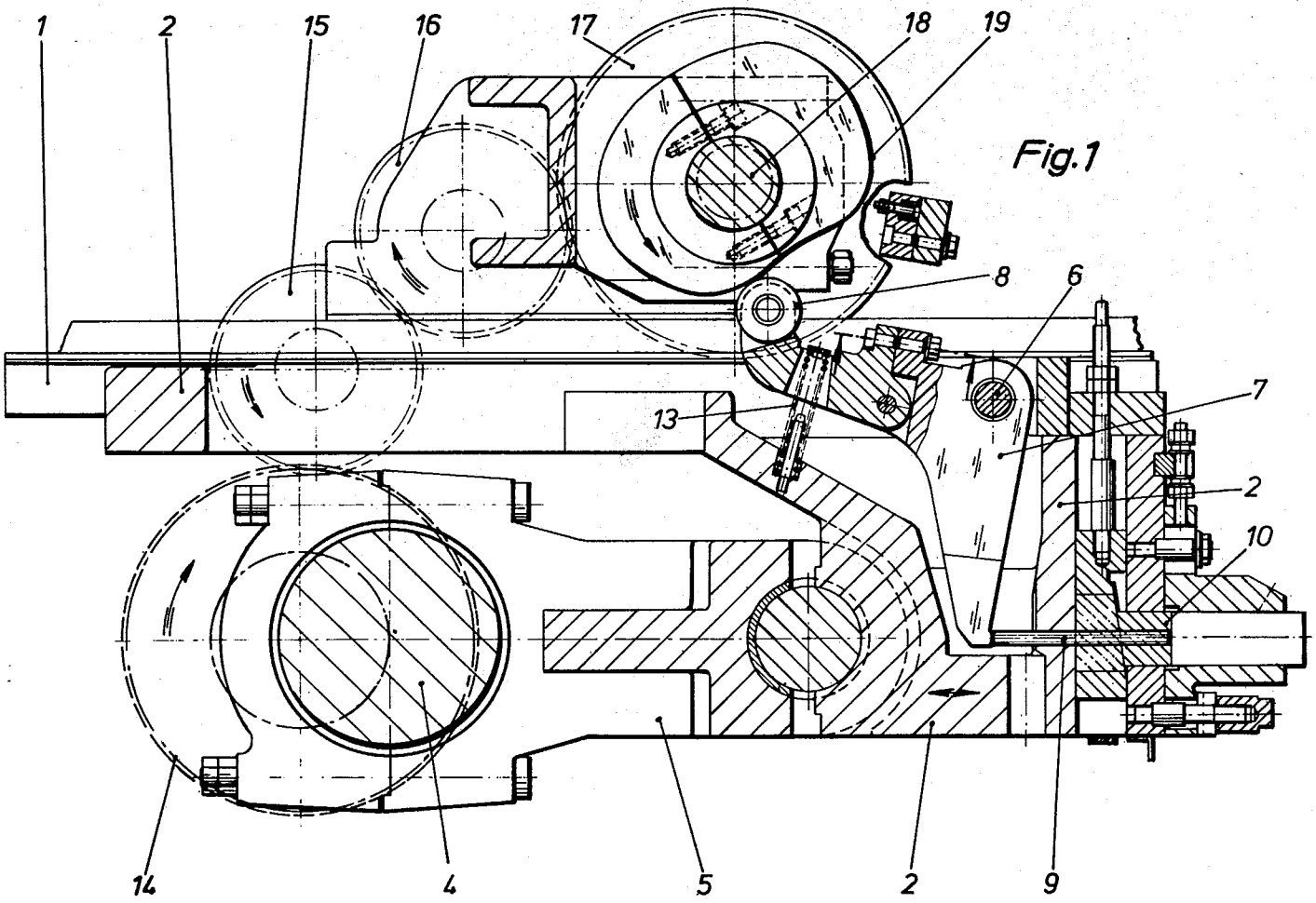
FIG. 1 is a cross-sectional elevational view of a crank press having a crank shaft drive for the sled and a drive for an ejector.
Figure 2:
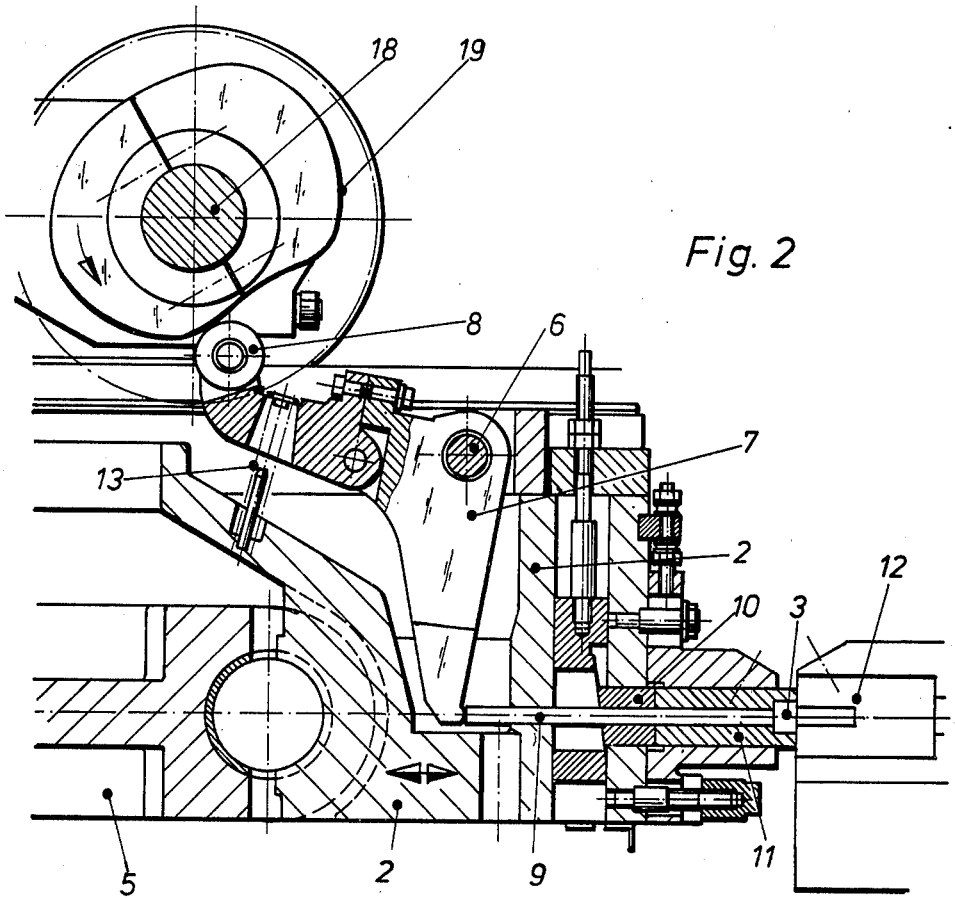
FIG. 2 is a cross-sectional side elevational view of a portion of the arrangement of FIG. 1 in which the pressing sled is in the forward-most position and the ejector is in the rearward position.
Figure 3:
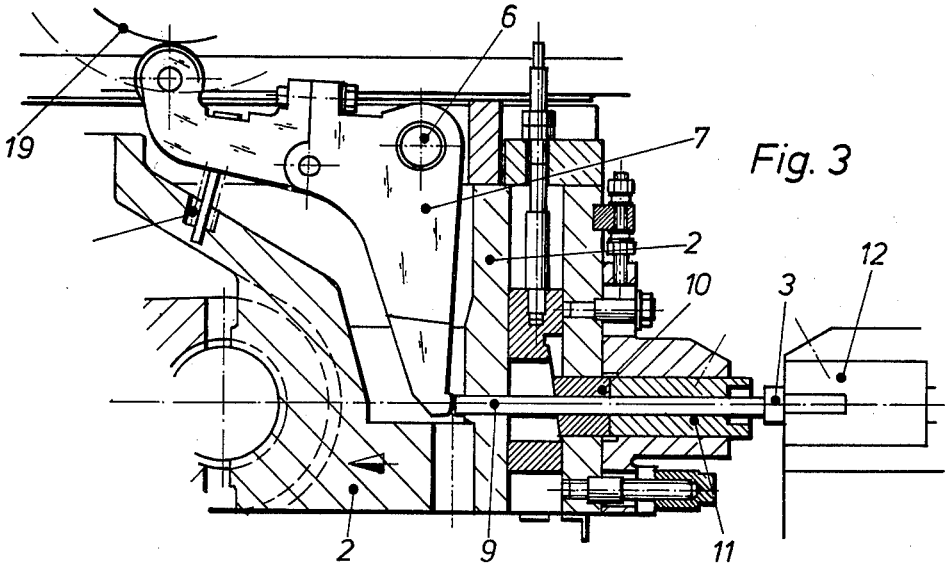
FIG. 3 is a cross-sectional elevational view similar to that of FIG. 2, wherein the pressing sled is in the rearward position and the ejector is in the forward position.

Referring now to the drawings, there is illustrated a machine frame 1 on which there is reciprocally mounted a pressing sled 2, whose function is to coact with the tools mounted on the sides of the sled and the stationary die 12 or dies 12 thereby fabricating workpieces 3 on a plurality of side-by-side disposed working stations, such as screws, bolts, bowl-shaped objects and the like from blanks. A crank rod 5 is operatively moved by means of a stationarily mounted rotating crank shaft 4. This arrangement provides for a reciprocal movement of the pressing sled 2 connected thereto as illustrated by the double arrow in FIG. 1. There is furthermore mounted on the pressing sled 2 a toggle lever 7 which is pivotally mounted about a swing axis 6. The upper end of the toggle lever has rotatably mounted thereon a cam-following roller 8. For purposes of coacting with the lower end of the toggle lever 7, there is provided an ejector rod 9 which is slidably movably mounted in the sled 2 as well as in the positioning bush 10. In front of the positioning bush 10 there is mounted a ram 11, the contour and shape of which forms and shapes the workpiece 3 when the pressing sled 2 is advanced.

The toggle lever 7 bears with a coil spring 13 against a portion of the sled 2 so that the cam-following roller 8 is continuously in contact with the surface of the cam disc 19.

The large crank shaft gear wheel 14 is rotatably but not movably mounted relative to the machine on the crank shaft 4. The gear wheel 14 is in driving engagement via two smaller intermediate gear wheels 15 and 16 with a large control cam gear wheel 17 mounted on the drive cam shaft 18, so that the gear wheels 14, 15, 16, and 17 as well as the shaft 18 are in driving engagement with each other. There are mounted side by side on the drive cam shaft 18 one or more cam discs 19. The drive gear arrangement 14, 15, 16, 17 is constructed in such a way that the drive cam shaft 18 has the same angular velocity as the crank shaft 4. The contour of the rotating cam disc 19 is shaped in such a way that the cam-following roller 8 and the toggle lever 7, which is mounted on the reciprocating sled 2, causes the ejection rod 9 to carry out such a movement relative to the sled 2, so that it remains stationary within a certain angular range of the cam disc despite the fact that the sled 2 carries out retraction at least partly during the same time frame, that is, the ejection rod 9 describes in this angular region a synchronous run relative to the sled path, which is phase-shifted by 180° relative thereto.

In the forward directed motion the ejector rod 9 pushes the workpiece 3 securely out of the ram 11 and it is in this way that the workpiece 3 remains firstly still in the die 12. It is within the concept of the invention to advantageously provide the drive cam shaft 18 with a plurality of cam discs 19 so that, for example, the press sled 2 can be used for the simultaneous working of a plurality of workpieces on a plurality of adjacently disposed working stations.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. In an improved crank press arrangement having a frame, a lateral ejector rod, and reciprocating sled movably mounted on said frame which is driven by a crank drive, wherein the ejector rod is slidably mounted in the sled and a positioning bush and coacts with a die, a toggle lever being pivotably mounted on said sled and having a first arm coacting with said ejector rod, and having a second arm on which a cam-follower roller is rotatably mounted, a control cam rotatably mounted and being in operative contact with said cam-follower roller, the improvement comprising that the contour and shape of the control cam, rotatably mounted in said frame, is such that while the cam-follower roller is in continuous contact therewith, nevertheless a temporary standstill of the ejector rod occurs relative to the frame during the operative cycles of the arrangement.

2. In the improved crank press arrangement the improvement as defined in claim 1, wherein the angular velocity of the crank drive and the control cam are equal.

3. In the improved crank press arrangement the improvement as defined in claim 2, wherein the rotational direction of the crank drive and control cam are opposite.

* * * * *